US008170255B2

(12) United States Patent
Visscher et al.

(10) Patent No.: US 8,170,255 B2
(45) Date of Patent: May 1, 2012

(54) ENCLOSURE FOR ACOUSTIC INSULATION OF AN APPARATUS CONTAINED WITHIN SAID ENCLOSURE

(75) Inventors: Albert Visscher, Veldhoven (NL); Joseph Hubert Marie Guillaume Schroen, Eindhoven (NL)

(73) Assignee: FEI Company, Hillsboro, OR (US)

( * ) Notice: Subject to any disclaimer, the term of this patent is extended or adjusted under 35 U.S.C. 154(b) by 1346 days.

(21) Appl. No.: 11/701,020

(22) Filed: Jan. 31, 2007

(65) Prior Publication Data

US 2007/0189567 A1 Aug. 16, 2007

(30) Foreign Application Priority Data

Feb. 1, 2006 (EP) ..... 06101129

(51) Int. Cl.
*H04R 25/00* (2006.01)

(52) U.S. Cl. ..... 381/353; 381/345; 381/354

(58) Field of Classification Search ..... 381/337–341, 381/343, 345, 346, 348, 349, 352, 353, 354
See application file for complete search history.

(56) References Cited

U.S. PATENT DOCUMENTS

| | | | | |
|---|---|---|---|---|
| 3,867,996 | A * | 2/1975 | Lou | 181/148 |
| 4,146,999 | A | 4/1979 | Petrovec et al. | |
| 4,224,469 | A * | 9/1980 | Karson | 381/353 |
| 4,362,222 | A * | 12/1982 | Hellstrom | 181/295 |
| 4,605,093 | A | 8/1986 | Karlen | |
| 4,837,837 | A * | 6/1989 | Taddeo | 381/346 |
| 5,333,204 | A * | 7/1994 | Hamada et al. | 381/346 |
| 5,373,564 | A * | 12/1994 | Spear et al. | 381/352 |
| 5,815,589 | A * | 9/1998 | Wainwright et al. | 381/346 |
| 6,113,056 | A | 9/2000 | Armstrong | |
| 6,278,789 | B1 * | 8/2001 | Potter | 381/338 |
| 6,324,292 | B1 * | 11/2001 | Mitsuhashi et al. | 381/349 |
| 6,593,581 | B2 | 7/2003 | Visscher | |
| 7,091,497 | B2 | 8/2006 | Visscher | |

FOREIGN PATENT DOCUMENTS

| | | |
|---|---|---|
| DE | 20011448 | 10/2001 |
| DE | 20020044 | 4/2002 |
| GB | 1495069 | 12/1977 |
| JP | 60-98986 | 7/1985 |
| JP | 2002-73036 | 3/2002 |

* cited by examiner

*Primary Examiner* — Suhan Ni

(74) *Attorney, Agent, or Firm* — Scheinberg & Griner, LLP; Michael O. Scheinberg; David Griner

(57) ABSTRACT

An enclosure with a substantial rectangular configuration, adapted to contain an apparatus sensitive to acoustic vibrations, the enclosure comprising walls and acoustic damping material located within the wall, wherein the acoustic damping material comprises at least one absorbing body of acoustic energy absorbing material located adjacent to a rib of the enclosure.

The acoustic vibrations most disturbing the processes in the apparatus within the enclosure are caused by standing acoustic waves within the enclosure with frequencies in the range between 50 Hz and 1000 Hz. These acoustic waves are efficiently damped by the provision of a block of acoustic absorbing material adjacent to one of the ribs of the enclosure, to such an extent that the need for thick walls of the enclosure is substantially obviated, leading to a less voluminous enclosure.

20 Claims, 4 Drawing Sheets

ENCLOSURE FOR ACOUSTIC INSULATION OF AN APPARATUS CONTAINED WITHIN SAID ENCLOSURE

CROSS-REFERENCE TO RELATED APPLICATIONS

NOT APPLICABLE

STATEMENT REGARDING FEDERALLY SPONSORED RESEARCH OR DEVELOPMENT

NOT APPLICABLE

REFERENCE TO A "MICROFICHE APPENDIX"

NOT APPLICABLE

NAMES OF THE PARTIES TO A JOINT RESEARCH AGREEMENT

NOT APPLICABLE

FIELD OF THE INVENTION

The present invention relates to acoustic insulation of apparatus which are sensitive or vulnerable to vibrations. Examples of this kind of apparatus are wafer steppers and particle-optical apparatus like electron microscopes. Other types of apparatus are however not excluded.

BACKGROUND

Often apparatus of this kind have to be operated at locations where vibrations, such as acoustic vibrations, are present, like in production facilities for semiconductors, also known as 'FAB's. In such circumstances it is important to use enclosures to insulate the apparatus from its environment, to be able to operate these apparatus within their boundary conditions.

Consequently enclosures with a substantial rectangular configuration are known which are adapted to contain an apparatus sensitive for acoustic vibrations, the enclosure comprising walls and acoustic damping material located within the wall.

These prior art enclosures need to be voluminous and heavy to be able to effect a sufficient insulation. This appears from the thickness of the walls which is commonly between 50 mm and 100 mm. This thickness is however often insufficient to provide the desired acoustic insulation. Of course the enclosure could be built thicker, but this either leads to a smaller internal volume of the enclosure, leaving less space around the apparatus, which is awkward during the installation and servicing, or to a larger external volume of the enclosure, resulting in added use of floor space.

U.S. Pat. No. 4,362,222 discloses an enclosure with a substantial rectangular configuration, adapted to contain an apparatus sensitive to acoustic vibrations, the enclosure comprising walls and acoustic damping material located within the wall, wherein the acoustic damping material comprises at least one absorbing body of acoustic energy absorbing material having the shape of a parallelepiped located adjacent to an edge of the enclosure.

In this prior art structure the damping material his formed by slabs having only a limited thickness, coherent with that fact that only a limited damping of acoustic frequencies in the frequency range for which the human ear is sensible is aimed for.

It has appeared to the inventor that the acoustic vibrations most disturbing the processes in the apparatus within the enclosure are surprisingly caused by standing acoustic waves within the enclosure. In most cases these apparatus are particularly vulnerable for vibrations with frequencies in the range between 50 Hz and 1000 Hz, as caused by the nature of these apparatus. This frequency area of the vibrations to be avoided is rather different from the frequency area for which the human ear is in particular sensible. This discrepancy avoids that prior art insulating features known to be effective for protection of the human hearing can be simply adapted for this purpose.

Further DE-U-200 11 448 discloses a building wherein absorbing bodies are arranged suspended on horizontal lines allowing the bodies to be moved along these lines, allowing the vibration absorbing bodies to be located adjacent to the edge of a building.

This kind of standing acoustic waves within this specific frequency area is efficiently damped by an enclosure of the kind referred to above wherein the size of at least one side of the at least one absorbing body is substantially equal to ¼ of the inner size of the enclosure in the same direction.

The space required for the absorbing body is even further reduced if this body has a substantially rectangular shape and if the size of at least one side of the at least one absorbing body is substantially equal to ¼ of the inner size of the enclosure in the same direction. Another advantage of this feature is the fact that such rectangular bodies are easily available.

To minimize disturbance of the operation of the apparatus within the enclosure it is advantageous if the volume of the absorbing body is as small as possible and if it is concentrated in a single location. This is the case if the enclosure comprises only one absorbing body, that the body is located adjacent to a corner of the enclosure and that all three sizes of the absorbing body are substantially equal to ¼ of the relevant inner sizes of the enclosure in the same directions.

Disturbance to operations within the enclosure is even further reduced if the absorbing body is located at one of the upper corners of the enclosure.

Although other damping materials, like natural wool and fiber composites are not excluded, it has appeared that mineral wool is particularly advantageous as a damping material, as it has good absorption properties, it has a low weight and it is cheap.

It has appeared to inventor that especially mineral wool with a density of 10-100 kg/m$^3$ leads to advantageous results.

Despite its advantageous properties, mineral wool and other fiber like materials suitable as absorbing materials may generate dust, which is not only unpleasant for humans in the enclosure, but which may also have a disastrous influence on the delicate apparatus present in the enclose and on the processes executed by them.

Therefore it is advantageous if the absorbing body is packed in an envelope of flexible material. This will keep any dust generated in the absorbing body within the envelope, so that the dust is not expelled. Of course the material of the envelope should be chosen carefully, so that the acoustic waves are properly transferred to the absorbing body and the waves are not reflected.

BRIEF SUMMARY OF THE INVENTION

The invention relates to an enclosure with a substantial rectangular configuration, adapted to contain an apparatus sensitive to acoustic vibrations, the enclosure comprising walls and acoustic damping material located within the wall, wherein the acoustic damping material comprises at least one absorbing body of acoustic energy absorbing material located adjacent to a rib of the enclosure.

The acoustic vibrations most disturbing the processes in the apparatus within the enclosure are caused by standing acoustic waves within the enclosure with frequencies in the range between 50 Hz and 1000 Hz. These acoustic waves are efficiently damped by the provision of a block of acoustic absorbing material adjacent to one of the ribs of the enclosure, to such an extent that the need for thick walls of the enclosure is substantially obviated, leading to a less voluminous enclosure.

BRIEF DESCRIPTION OF THE SEVERAL VIEWS OF THE DRAWINGS

Subsequently the present invention will be elucidated with the help of the following drawings in which.

DETAILED DESCRIPTION OF THE INVENTION

As stated above the invention is based on the assumption that the main cause of acoustic vibrations disturbing the apparatus and the processes taking place therein are caused by standing waves. However to avoid that acoustic vibrations reach the enclosed apparatus, it is preferred that the walls of the enclosure are made of a material with a relative high mass per surface area. This is based on the view that the acoustic waves from outside the enclosure are reflected better by walls with a high mass per surface area. This, together with the damping of the standing waves by an absorber block placed adjacent to a rib of the enclosure (preferably a corner of the enclosure) results in a lower acoustic noise level inside the enclosure.

From studies it has appeared that optimal results are obtained if the enclosure is made of a material with a mass of between 10 kg/m$^2$ and 60 kg/m$^2$. This allows materials with a relative small thickness to be used enhancing the effects pointed out above, such as steel sheet.

The most optimal results are however obtained if the enclosure is made of sheet metal with a thickness between 0.5 mm and 5 mm and a layer of bitumen applied at the outside of the metal sheet with a thickness approximately twice the thickness of the metal sheet.

Particle-optical apparatus are particularly vulnerable to acoustic vibrations so that the advantages of the invention appear in particularly when the enclosure is adapted to contain a particle-optical apparatus. The adaptation appears from the size of the enclosure being adapted to the size of such particle-optical apparatus.

Figure 1:
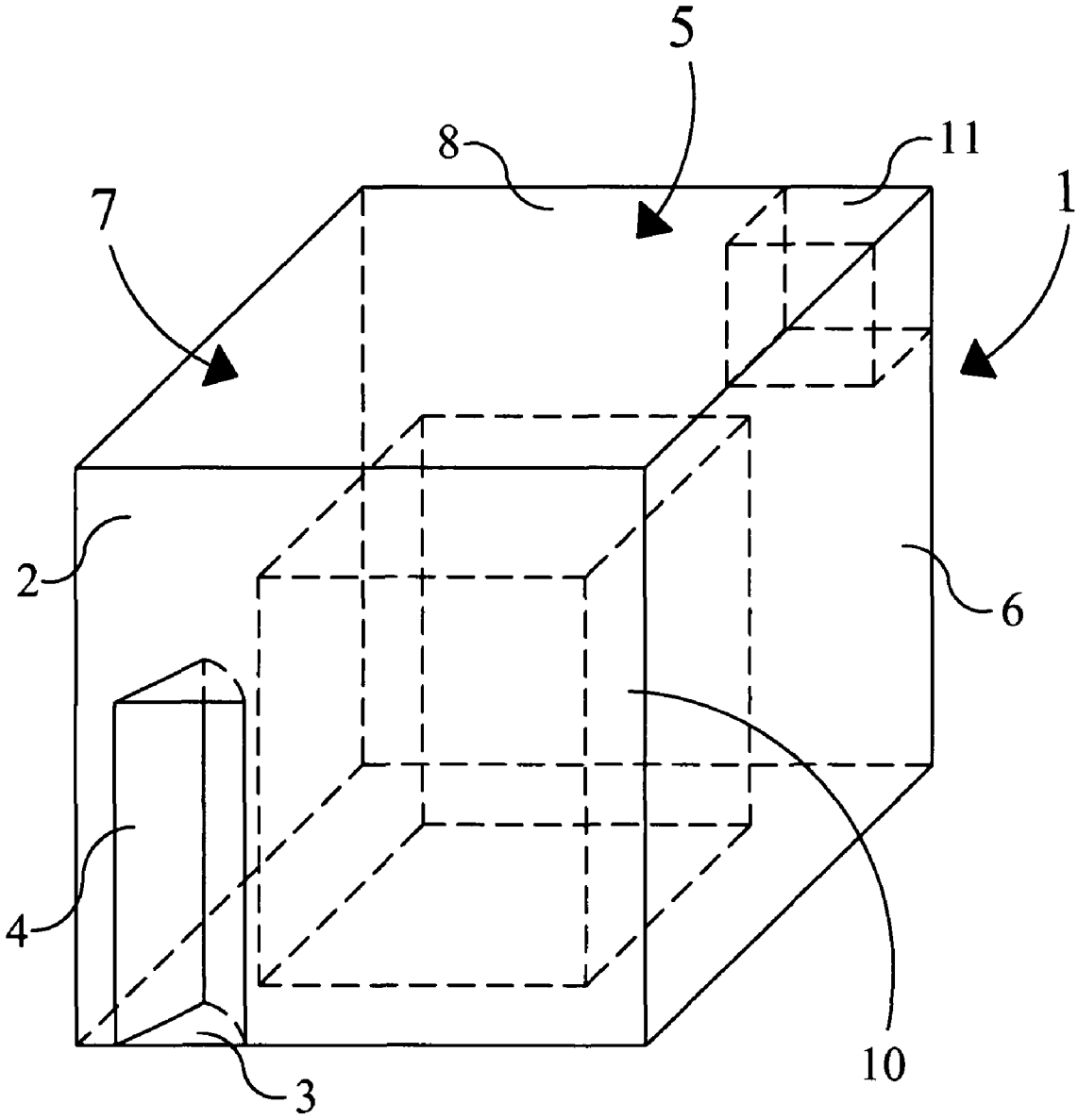
FIG. 1 shows a diagrammatic view of a first embodiment of the invention.

In FIG. 1 an enclosure 1 is shown having a substantial rectangular configuration which is also known as the configuration of a parallelepiped. More in particular the enclosure comprises a front wall 2 into which an aperture 3 has been provided into which a door 4 has been inserted, a rear wall 5, two side walls 6, 7 respectively and an upper wall or roof 8. All these walls 2, 5-8 are made of metal plate with a thickness of 1 mm. The thickness may however vary between 0.5 mm and 5 mm, more preferably between 0.75 mm and 1.5 mm. The inner surface of the walls is covered with a layer of bitumen or other material with a high specific mass to increase the mass per surface area of the walls, while simultaneously damping resonance of the enclosure walls. Other materials, both as replacement for the metal plate and for the bitumen layer are not excluded. This weight per surface area serves to improve the reflection of acoustic waves, resulting in the desired acoustic insulation from the inner volume of the enclosure to the outside.

Within the enclosure 1 an apparatus 10 schematically depicted has been positioned which apparatus is sensitive to acoustic vibrations. Examples of such apparatus are wafer steppers, electron microscopes or other equipment of particle-optical nature. The enclosure is substantially larger than the apparatus to offer space for maneuvering and operating around the apparatus.

It deserves mention that as an alternative it is also possible to design an enclosure with a reduced floor space when compared to prior art enclosures with similar acoustic insulation.

To offer an effective way of damping standing waves within the enclosure an acoustic body 11 made of mineral wool has been provided in one of the upper corners of the enclosure. As depicted in the drawing, the body has a substantial rectangular or block shape. This is however not specifically required; other shapes, like prismatic shapes and irregular shapes may be used as well. Block shapes are however preferred as they provide an optimal absorption for standing waves within the enclosure.

The damping effect is caused by the fact that due to the refection of the waves against the inner surface of the walls, the standing waves not only of the first order but also of higher orders have their maximum pressure amplitudes at the walls, so that any absorption material at the walls will be most effective. Consequently the best position for the absorption material is adjacent to the walls.

It has further appeared that when the material extends over substantially a quarter of the longitudinal sizes of the enclosure an optimal absorption and hence damping effect is obtained, as this covers the area's wherein the pressure amplitude of the acoustic waves is the largest.

A location in a corner is advantageous as it is effective in all three spatial dimensions of the enclosure, whereas further the space required is only minor. If the preferred dimensions of a quarter of the dimension of the enclosure are taken, assuming the presence of a rectangular enclosure, only $\frac{1}{4}\times\frac{1}{4}\times\frac{1}{4}=\frac{1}{64}$ of the total volume of the enclosure is taken. The space burden is brought to an absolute minimum when the absorbing body is located in one of the top corners as in the present embodiment.

Preferably the absorbing body is provided in an envelope to avoid dust, small fibers and other material reaching the apparatus, especially when mineral wool is used.

Figure 2:
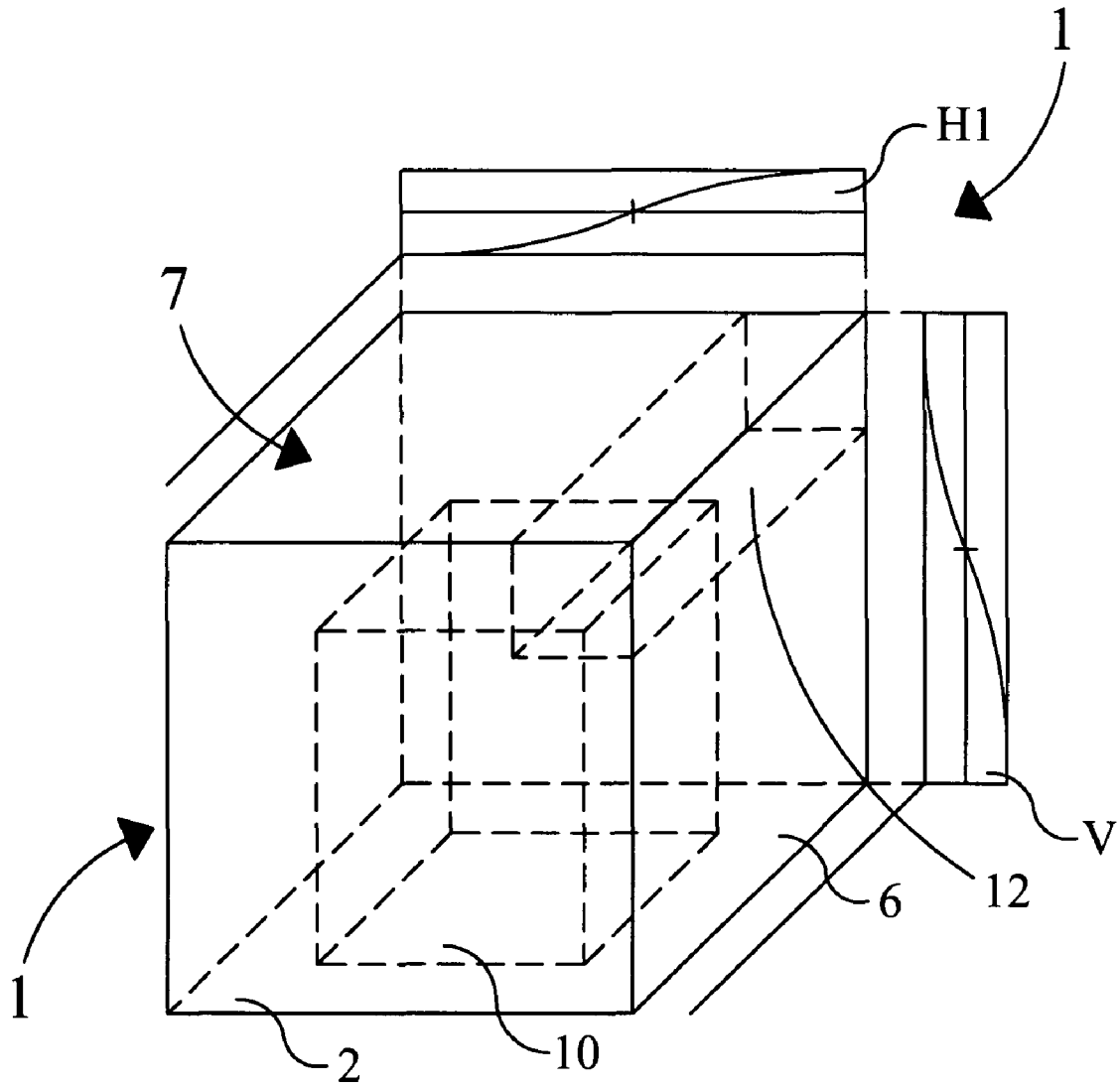
FIG. 2 shows a diagrammatic view of a second embodiment of the invention.

It is however also possible to make use of an acoustic absorbing body extending over the full length of one of the ribs. Such a situation is depicted in FIG. 2, wherein an acoustic absorbing body 12 is located adjacent to one of the upper ribs. This embodiment provides a better damping as standing waves in two of the three perpendicular directions will contact the absorbing body over the full width of the volume in which the standing waves are present. This is indicated by the diagrams V, and $H_1$ respectively.

Figure 3:
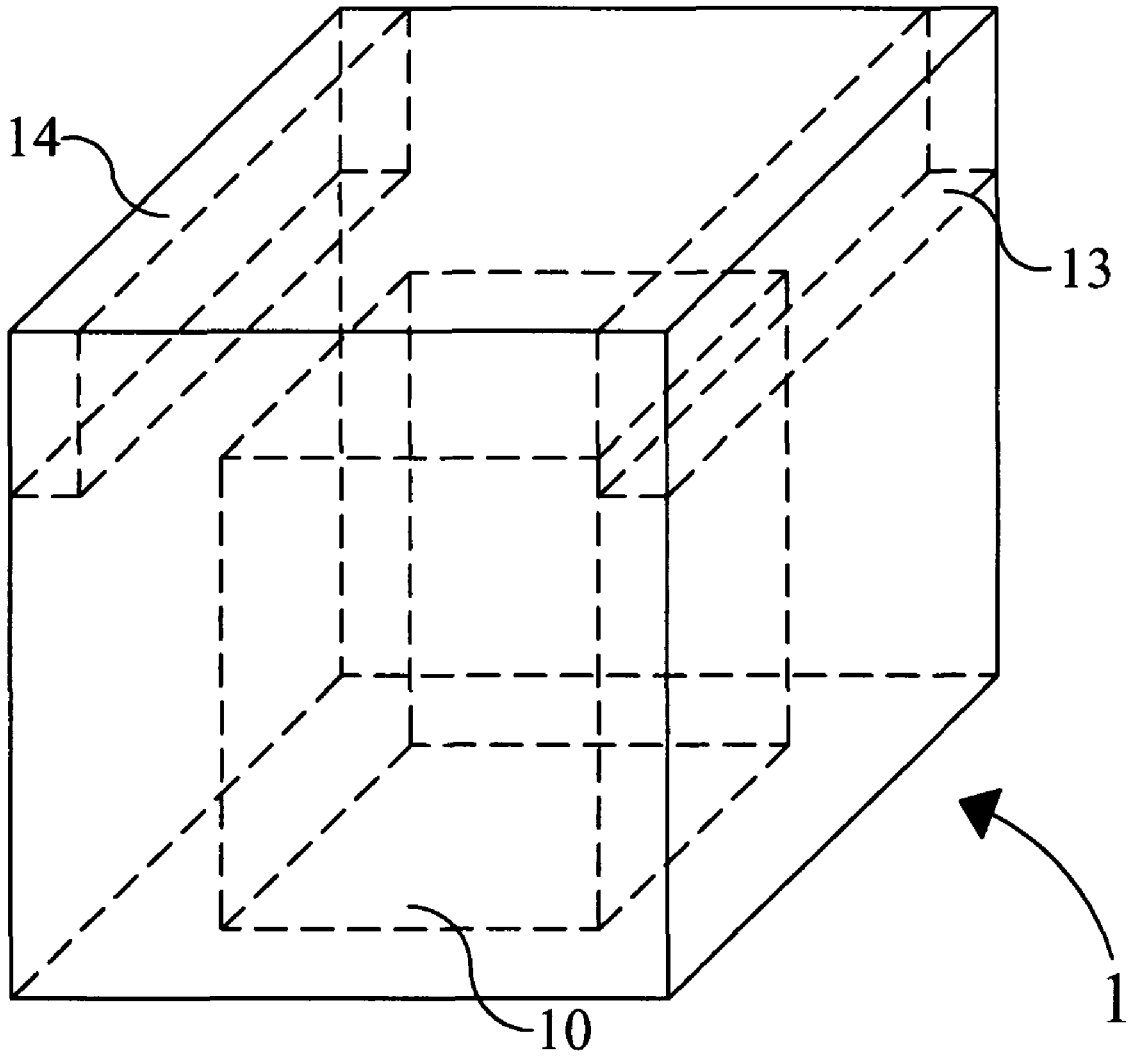
FIG. 3 shows a diagrammatic view of a third embodiment of the invention.

The situation in FIG. 3, wherein two acoustic absorption bodies 13, 14 have been provided provides the same advantage as the embodiment of FIG. 2, but spatial conditions may render this embodiment attractive in some situations. Of course the sizes of the acoustic absorption bodies may be adapted to contain the same aggregate volume as in the preceding embodiment.

Figure 4:
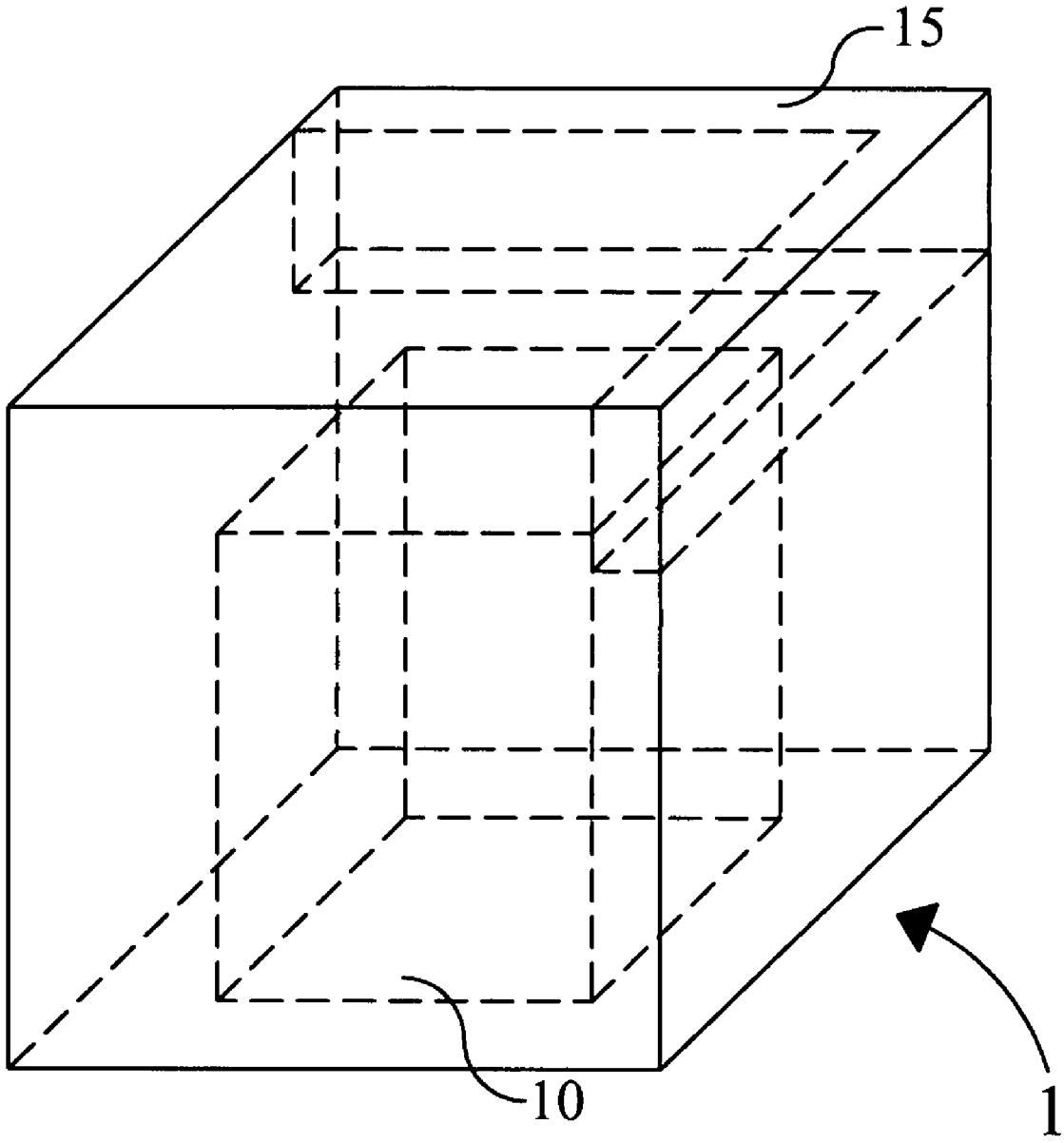
FIG. 4 shows a diagrammatic view of a fourth embodiment of the invention.

Finally FIG. 4 shows an embodiment wherein a single acoustic absorbing body 15 is used, albeit with an L-shape and which extends along two of the ribs of the enclosure. The effect of this embodiment is that standing waves in all three directions are absorbed by the body, so that the effectiveness is increased. Of course this body may be composed of several separate bodies united together, just as in preceding embodiments.

It will be clear that numerous amendments may be made to the embodiments described above.

We claim as follows:

1. Enclosure with a substantial rectangular configuration, adapted to contain an apparatus sensitive to acoustic vibrations, the enclosure comprising walls and acoustic damping material located within the enclosure, wherein the acoustic damping material comprises at least one absorbing body of acoustic energy absorbing material, in which the size of at least one side of a rectangular circumscribing envelope of the body is substantially equal to ¼ of the inner size of the enclosure in the same direction.

2. Enclosure as claimed in claim 1, in which the enclosure comprises only one absorbing body, that the body is located adjacent to a corner of the enclosure and that all three sizes of the absorbing body are substantially equal to ¼ of the relevant inner sizes of the enclosure in the same directions.

3. Enclosure as claimed in claim 2, in which the absorbing body is located at one of the upper corners of the enclosure.

4. Enclosure as claimed in claim 2, in which the absorbing body is packed in an envelope of flexible material.

5. Enclosure as claimed in claim 2, in which the enclosure is made of a material with a mass per surface area of between 10 kg/m2 and 60 kg/m2.

6. Enclosure as claimed in claim 1, in which the absorbing body is located at one of the upper corners of the enclosure.

7. Enclosure as claimed in claim 1, in which the absorbing body is made of mineral wool.

8. Enclosure as claimed in claim 7, in which the mineral wool has a density of 10-100 kg/m3.

9. Enclosure as claimed in claim 1, in which the absorbing body is packed in an envelope of flexible material.

10. Enclosure as claimed in claim 1, in which the enclosure comprises walls made of a material with a high mass per surface area.

11. Enclosure as claimed in claim 10, in which the enclosure is made of a material with a mass per surface area of between 10 kg/m2 and 60 kg/m2.

12. Enclosure as claimed in claim 10, in which the walls of the enclosure are made of sheet metal with a thickness between 0.5 mm and 5 mm and a layer of bitumen applied at the outside of the metal sheet with a thickness approximately twice the thickness of the metal sheet.

13. Combination of an enclosure as claimed in claim 1, with an apparatus sensitive to acoustic vibrations, in particular a particle-optical apparatus.

14. A method of reducing vibration affecting an apparatus sensitive to acoustic vibrations, comprising;

providing an enclosure having a substantial rectangular configuration around the apparatus sensitive to acoustic vibrations;

providing within the enclosure an acoustic damping material including at least one absorbing body of acoustic energy absorbing material, the size of at least one side of a rectangular circumscribing envelope of the body is substantially equal to ¼ of the inner size of the enclosure in the same direction.

15. The method of claim 14 in which providing an acoustic damping material includes providing only one absorbing body, the body being provided adjacent to a corner of the enclosure and each of three dimensions of the absorbing body being substantially equal to about ¼ of the dimension of the enclosure in the same directions.

16. The method of claim 14 in which providing an acoustic damping material includes providing the acoustic damping material at one of the upper corners of the enclosure.

17. The method of claim 14 in which providing an acoustic damping material includes providing mineral wool.

18. The method of claim 14 in which providing an acoustic damping material includes providing a sampling material having a density of 10-100 kg/m$^3$.

19. The method of claim 14 in which providing an enclosure having a substantial rectangular configuration around the apparatus sensitive to acoustic vibrations includes providing an enclosure having walls made of a material with a mass per surface area of between 10 kg/m$^2$ and 60 kg/m$^2$.

20. The method of claim 14 in which providing an enclosure having a substantial rectangular configuration around the apparatus sensitive to acoustic vibrations includes providing an enclosure having a substantial rectangular configuration around a particle optical apparatus.

* * * * *